US005887659A

United States Patent [19]

Watkins

[11] Patent Number: 5,887,659

[45] Date of Patent: Mar. 30, 1999

[54] RISER FOR USE IN DRILLING OR COMPLETING A SUBSEA WELL

[75] Inventor: Bruce J. Watkins, Houston, Tex.

[73] Assignee: Dril-Quip, Inc., Houston, Tex.

[21] Appl. No.: 856,075

[22] Filed: May 14, 1997

[51] Int. Cl.[6] ..... F21B 17/01

[52] U.S. Cl. ..... 166/350; 166/367; 405/224.2; 405/224.3

[58] Field of Search ..... 166/350, 351, 166/367; 405/224.1, 224.2, 224.3, 224.4

[56] References Cited

U.S. PATENT DOCUMENTS

| | | | |
|---|---|---|---|
| 3,332,484 | 7/1967 | Watkins | 166/359 X |
| 3,433,504 | 3/1969 | Hanes . | |
| 3,450,421 | 6/1969 | Harwell, Jr. | 166/359 X |
| 3,601,187 | 8/1971 | Tidwel . | |
| 3,614,869 | 10/1971 | Flory et al. | 405/224.2 |
| 3,695,633 | 10/1972 | Hanes . | |
| 3,782,458 | 1/1974 | Slack | 166/355 |
| 3,791,442 | 2/1974 | Watkins | 166/352 |
| 3,934,528 | 1/1976 | Horton et al. . | |
| 3,949,693 | 4/1976 | Bauer et al. . | |
| 3,953,905 | 5/1976 | Paitson . | |
| 4,033,277 | 7/1977 | Schaper . | |
| 4,098,333 | 7/1978 | Wells et al. . | |
| 4,167,279 | 9/1979 | Lucksinger . | |
| 4,185,694 | 1/1980 | Horton | 166/350 |
| 4,212,561 | 7/1980 | Wipkink | 166/367 X |
| 4,286,665 | 9/1981 | Walker | 166/339 |
| 4,367,981 | 1/1983 | Shapiro | 405/195.1 |
| 4,462,717 | 7/1984 | Falcimaigne . | |
| 4,502,551 | 3/1985 | Rule et al. | 175/6 |
| 4,516,881 | 5/1985 | Beynet et al. | 166/367 X |
| 4,606,675 | 8/1986 | Daniell | 405/210 |
| 4,648,848 | 3/1987 | Busch . | |
| 4,822,212 | 4/1989 | Hall et al. | 166/359 X |
| 4,892,444 | 1/1990 | Moore | 166/350 X |
| 4,893,965 | 1/1990 | Jordan | 405/202 |
| 5,007,482 | 4/1991 | Forsyth et al. | 166/345 |
| 5,150,987 | 9/1992 | White et al. | 405/224 |
| 5,269,629 | 12/1993 | Langner | 166/367 X |
| 5,323,860 | 6/1994 | Watkins . | |
| 5,395,183 | 3/1995 | Watkins | 166/350 X |
| 5,431,511 | 7/1995 | Guy | 405/223.1 |
| 5,439,321 | 8/1995 | Hunter | 405/195.1 |
| 5,479,990 | 1/1996 | Peppel | 166/350 |
| 5,558,467 | 9/1996 | Horton | 405/195.1 |
| 5,609,442 | 3/1997 | Horton | 405/205 |
| 5,639,187 | 6/1997 | Mungall et al. | 405/195.1 |

OTHER PUBLICATIONS

Article "Going Deep" (date unknown) from Sunday Advocate, Baton Rouge, Louisiana.

Drawing of Aker Omega No. 2782–DG–SB–PR–0031, dated May 2, 1996.

*Primary Examiner*—George Suchfield

*Attorney, Agent, or Firm*—Vaden, Eickenroht & Thompson, L.L.P.

[57] ABSTRACT

There is disclosed an assembly including a protective sleeve spaced about an intermediate pipe of a riser which is adapted to extend through an opening in the bottom of a vertical compartment of a offshore rig for use in drilling or completing a subsea well, with a ball shaped portion on the upper end of the sleeve is closely received by ball shaped surfaces of the upper portion of the riser pipe, while a ball shaped part on the lower portion of the riser pipe is so received within the lower end of the sleeve to permit them to swivel as well as to move vertically with respect to one another.

4 Claims, 3 Drawing Sheets

RISER FOR USE IN DRILLING OR COMPLETING A SUBSEA WELL

This invention relates generally to a riser for use in drilling or completing a subsea well from an offshore rig of the type having a series of vertical compartments beneath its platform, each to receive a riser and having an opening in its lower end through which a riser pipe intermediate the upper and lower ends of the riser is adapted to extend. More particularly, it relates to improvements in an assembly for protecting the portion of the riser which extends through the openings against bending stress and wear due to interference with the compartment opening.

As well known in the art of drilling and completing wells, a riser comprises a series of riser pipes connected in end to end relation and supported from the platform at its upper end from the rig, whether on land or subsea, and, in the latter case, whether fixed or floating. During the drilling or completion process, various equipment, including other smaller risers, are run through the riser to and from the well.

When the rig is moored to the ocean floor, as in the case of a spar buoy or tension leg platform, it undergoes intentional as well as unintentional motion. This in turn causes the riser pipes extending through the lower openings from the compartments of the rig to bear upon and rub against the openings, creating high stresses in the risers, and, at best, wear and eventual failure.

It has therefore been proposed to protect the affected riser pipe against bending stress and wear with an assembly known as a "keel joint" and usually in the form of a sleeve of large, heavy wall pipe rigidly or flexibly mounted about the riser pipe. For example, the sleeve may be rigidly mounted on the riser by means of tapered stress joints, which are expensive, or flexibly mounted thereon by elastomer sleeves or cushions between the riser and joint, which have limited service life.

The object of this invention is to provide an assembly for this purpose which is relatively inexpensive and long lasting as compared with the above described prior art.

This and other objects are accomplished, in accordance with the illustrated embodiments of the invention, by a riser of the type described having a protective sleeve spaced about an intermediate pipe thereof which will extend through the opening in the bottom of the compartment, and means including a spherically shaped surface adjacent the upper end of the intermediate pipe which is closely surrounded by a spherically shaped surface on the upper end of the sleeve to support the sleeve for swiveling with respect thereto. More particularly, additional means is provided adjacent the lower end of the sleeve to guideably receive a spherically shaped part adjacent the lower end of the intermediate pipe for swiveling as well as relative vertical movement with respect thereto, thus compensating for relative axial movement between them due to stretch, bending and/or temperature.

In one illustrated embodiment of the invention, the means adjacent the lower end of the sleeve includes a ring having an outer side vertically slidable within the inner side of the sleeve and having the spherically shaped surface about its inner side closely disposed about the lower spherically shaped surface of the riser pipe. More particularly, the ring comprises upper and lower sections split along a plane transverse to its axis, with the upper ring being made of circumferentially split segments which are moveable into an enlarged portion of the inner side of the sleeve above its lower end to permit passage of the lower spherical surface of the riser pipe. Thus, upon lowering of the lower spherical surface through the spread segments, the segments may be lowered back onto the lower ring section and then connected thereto to reform the upper section about the lower spherically shaped surface.

In another more simplified, but less preferred, embodiment the means adjacent the lower end of the sleeve comprises a cylindrical surface on the inner side of the sleeve in which the lower spherically shaped surface of the riser pipe is received for guided vertical sliding with respect thereto.

In the drawings, wherein like reference characters are used throughout to designate like parts:

Figure 1:
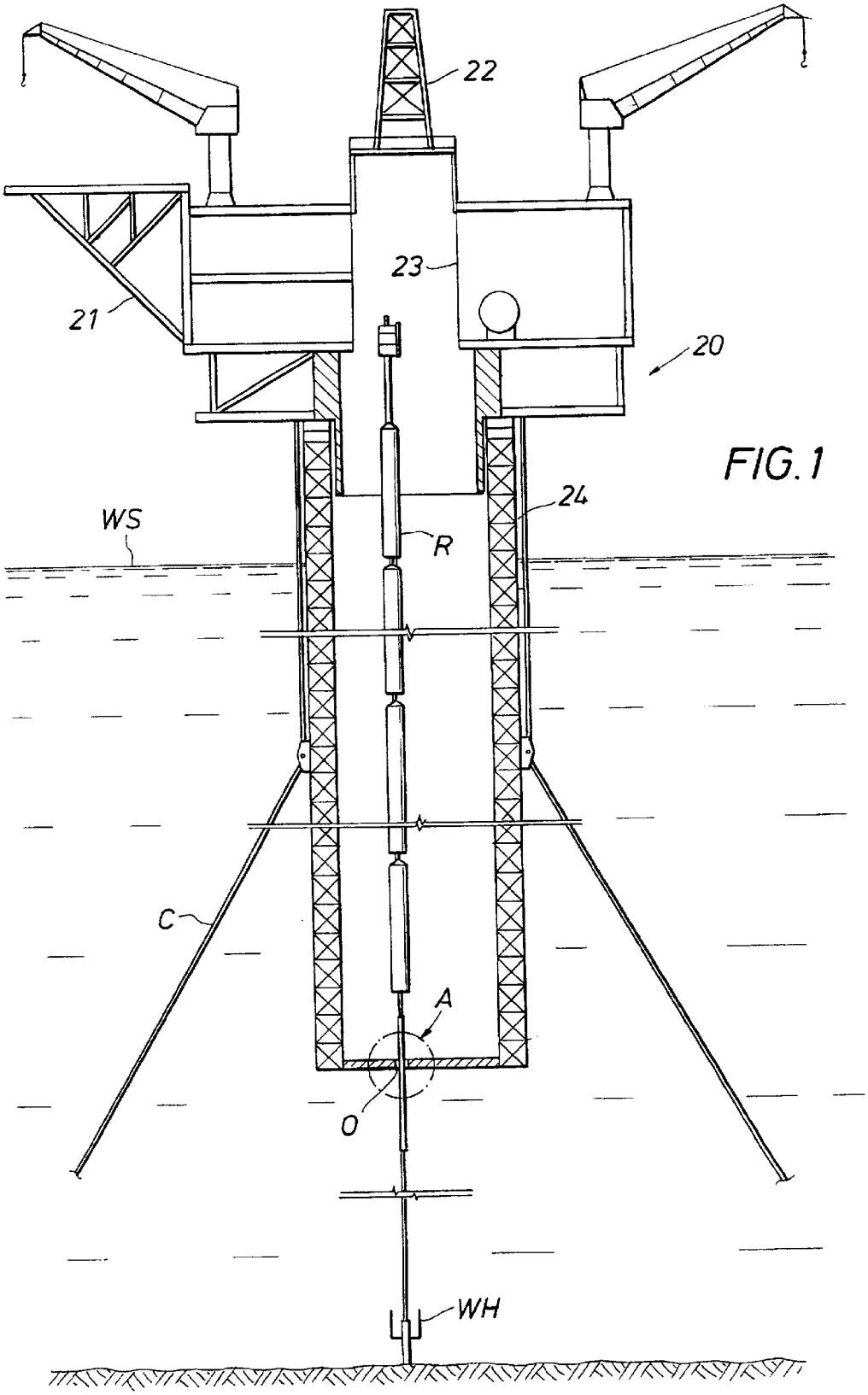
FIG. 1 is a side view of an offshore rig of the type contemplated by the present invention and showing a riser having its upper end supported therefrom and extending downwardly through an opening in the lower end in the bottom of a vertical compartment of a buoy which supports the platform of the rig to connect at its lower end with a subsea wellhead.

With reference now to the details of the above described drawings, the rig shown in FIG. 1 and designated in its entirety by reference character 20, includes a platform 21 having conventional equipment including a derrick 22 mounted and supported on the upper end of a spar buoy 24 which is of considerable length relative to its width. As shown, the platform is moored to the subsea surface by cables C to locate the buoy on the water surface WS.

As previously described, the buoy has a plurality of vertical compartments each of which has an opening O at its lower end generally above the subsea wellhead WH. More particularly, a riser R having its upper end supported from the rig extends downwardly through one of the compartments and the opening in its lower end for connection at its lower end to the wellhead. The riser may be of conventional construction, including suitable buoyancy members which are mounted about the riser between its upper and lower ends, except for assembly A, which, as circled in FIG. 1, forms an intermediate part thereof which extends through the opening O.

As previously mentioned, and as is well known in the art, the platform of an offshore rig of this type, as well as other types, such as so-called "tension leg" platforms, undergo substantial movement, both intentional and unintentional. This movement, which is primarily in a side-to-side or lateral direction, may result from wave action and/or controlled movement. In any case, as described previously, and again as is well known in the art, it has been found that, unless protected, the portion of the riser which extends through the opening at the lower end of the compartment undergoes considerable bending stresses as well as wear as an edge of the opening is forced against it.

Figure 2A:
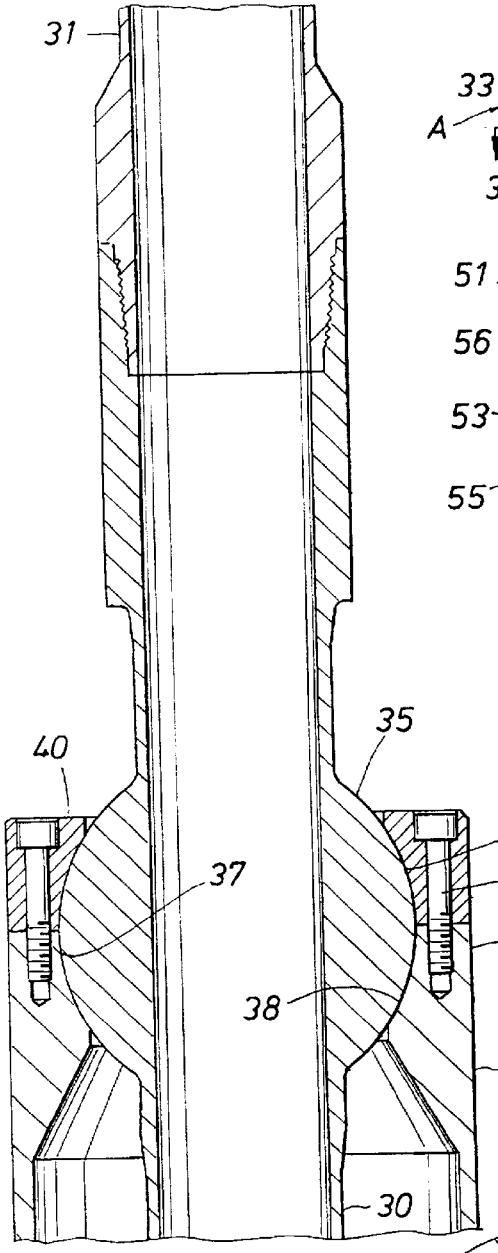
FIGS. 2A and 2B are enlarged vertical sectional views of an assembly constructed in accordance with the preferred embodiment of the invention and including a protective sleeve which is spaced about an intermediate pipe of the riser which extends through the opening.

As shown in FIGS. 1 and 2, the riser includes assembly A comprising an intermediate riser pipe 30 connected at its upper end to an upper riser pipe 31 and its lower end to a lower riser pipe 32, thus forming an intermediate part of the overall riser which is expected to extend through the opening O in a compartment of the buoy. The assembly A further includes a sleeve 33 of heavy wall pipe which is spaced about the intermediate riser pipe 30 for substantially its entire length and with its upper end supported by the riser pipe 30 adjacent its upper end and, its lower end aligned with the lower end of the intermediate riser pipe for guided vertical movement with respect thereto. More particularly, and as will be described in more detail to follow, in both illustrated embodiments of the assembly, the upper and lower ends of the sleeve and adjacent portions of the intermediate riser pipe are so constructed as to permit both ends to swivel with respect to one another as well as to permit their lower ends to move vertically with respect to one another, thus protecting the riser pipe against damage upon the above-described movement of the rig with respect to the wellhead, with little or no damage to the riser pipe itself, whether do to bending, rubbing, or vertical elongation or contraction with respect to one another.

For this purpose, in the preferred embodiment of the assembly, the intermediate riser pipe has a ball shaped part 35 adjacent its upper end and having a center lying within the vertical axis of the riser pipe so as to be symmetrical therewith. Spherically shaped surfaces 36 on opposite sides of the part are closely received within spherically shaped surfaces 37 formed on the inner side of the upper end of the sleeve. Thus, the upper end of the sleeve includes an enlarged annular portion which has a spherically shaped surface 38 fitting about generally the lower half of the ball shaped part 35, and a ring 40 having an inner surface fitted closely about the upper half of the ball shaped part is fixed to the top of the enlarged portion by means of bolts 41. Thus, as will be apparent from FIG. 2A, bolting of the ring to top of the enlarged upper end of the sleeve captures the ball shaped part 35 of the riser pipe to support the sleeve therefrom, while permitting swiveling between the ball shaped part and the sleeve.

The riser pipe also includes a ball shaped part 50 adjacent its lower end which, similarly to the upper ball shaped part, is symmetrical with respect to the axis of the riser pipe. However, it is of smaller diameter, and, rather than providing a support for the sleeve 33, is mounted within the lower end of the sleeve for not only swiveling with respect thereto, but also for guided vertical movement with respect thereto.

The upper and lower spherically shaped surfaces 51,52 of the ball shaped part 50 are contained within a ring 53 having matching upper and lower spherically shaped surfaces to closely receive the lower ball shaped part. The outer surface 54 of the ring is cylindrical for sliding closely within a cylindrical surface 55 of a radially reduced portion of the lower end of the sleeve to locate these cylindrical surfaces coaxially with the axis of the riser pipe and sleeve, and thus with the center of the ball shaped part, and thus permit the described relative axial movement.

Figure 2B:
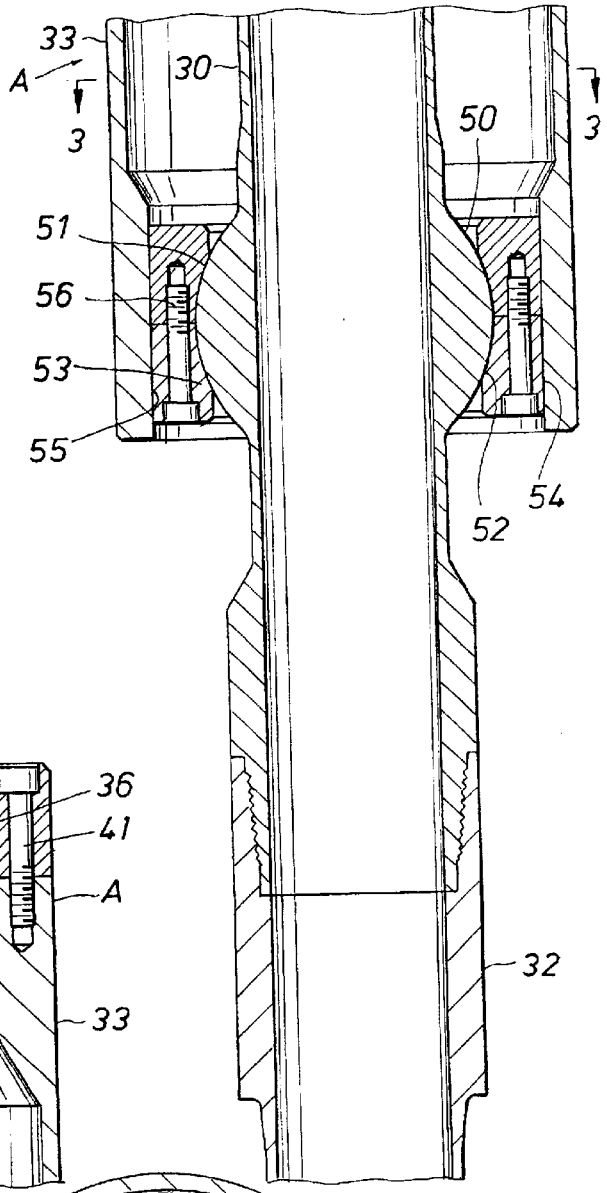
Figure 3:
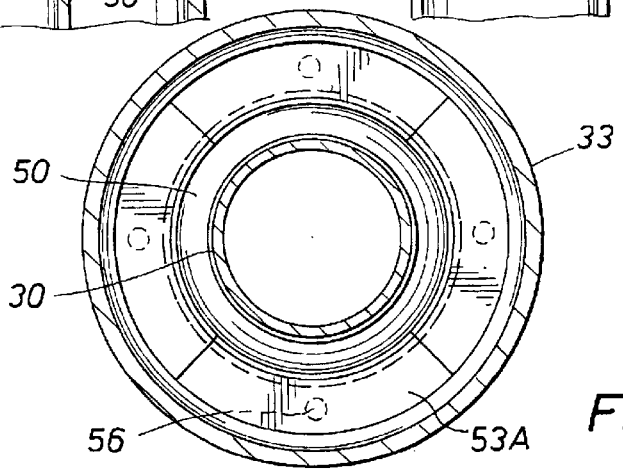
FIG. 3 is a cross-sectional view of the assembly, as seen along broken lines 3—3 of FIG. 2B.

The ring 53 is split into upper and lower sections along a plane passing through the center of the ball and perpendicular to the axis of the riser pipe, thus permitting the sections to be moved vertically toward and away from one another. When moved into assembled position, as shown in FIG. 2B, the sections are secured to one another by means of bolts 56 to capture the ball shaped part within their inner spherical surfaces.

Figure 5:
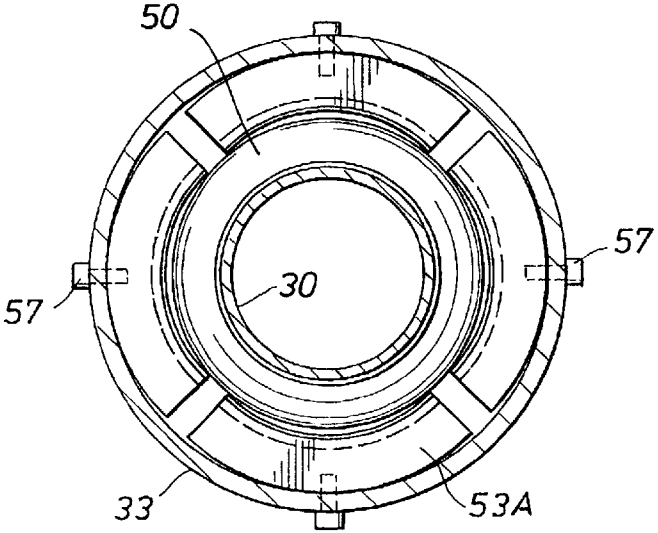
FIG. 5 is a cross-sectional view of the assembly, as seen along broken lines 5—5 of FIG. 4, to show the segments of the support ring in their elevated positions.
Figure 4:
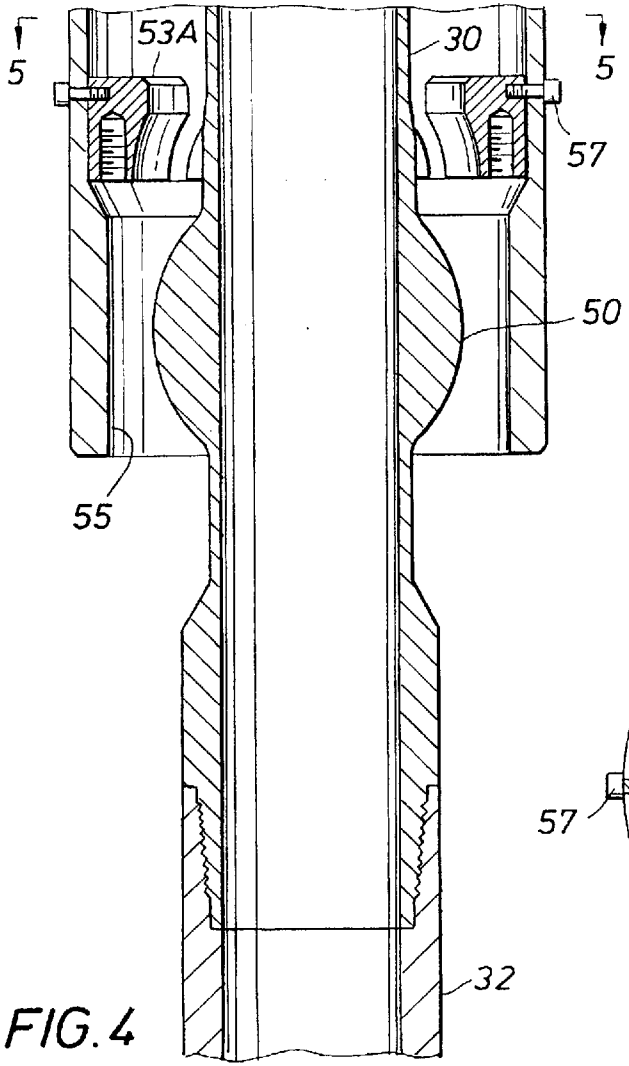
FIG. 4 is a view of the assembly similar to FIG. 2B, but during assembly of same wherein the segments of the upper section of a ring forming the lower cylindrical surface of the sleeve is supported above its assembled position of FIG. 2B in order to permit the passage of the spherically shaped part adjacent the lower end of the intermediate riser pipe.

In order to permit the riser pipe to be installed within a sleeve of one piece construction, the lower ball shaped part of the riser pipe is smaller than the opening through the enlarged upper end of the sleeve 33. Then, the upper half of the lower ring 53 is made up of circumferentially split segments 53A which are moveable between their lower, inner positions about the lower ball shaped part of the riser pipe, as shown in FIG. 2B, and outer, upper positions above the radially reduced cylindrical surface 55 at the lower end of the sleeve, as shown in FIG. 4, in which the inner spherical surfaces of the upper ring segments 53A are spaced outwardly to permit passage of the lower ball shaped part (see FIG. 5 as well). As shown in FIG. 4, they are held in these outer positions by means of pins 57 removeably disposed through aligned openings in the sleeve and the outer diameter of each of the ring segments. At the same time, release and lifting of the ring 40 enables the upper ball shaped part 35 to be lowered onto the sleeve surface 37, and then reconnected to sleeve 33 by bolts 41 to capture the upper ball shaped part.

With the sleeve supported at its upper end, and thus with the lower ball shaped part disposed opposite the inner cylindrical surface of the lower end of the sleeve, the segments 53A of the upper section of the ring may be released to drop downwardly into the inner surface of the sleeve and thus permit their inner surfaces to fit about the upper spherically shaped surfaces of the lower ball shaped part 50. The lower ring half 53 may then be moved upwardly through the cylindrical surface in the lower end of the sleeve and bolted to the upper segments of the upper ring by means of bolts 56. As previously described, when mounted about the lower ball shaped part of the riser pipe, the ring guides the lower end of the riser pipe vertically with respect to the sleeve while permitting it to swivel with respect to the lower end of the sleeve.

Figure 6:
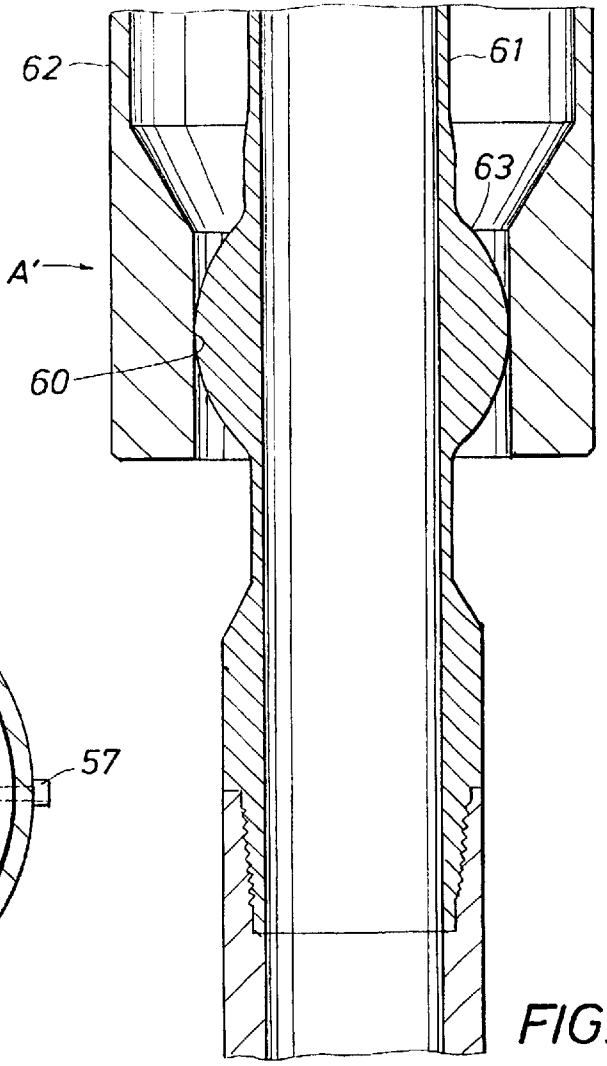
FIG. 6 is a vertical sectional view of the lower end of the alternative, but less preferred, embodiment of the assembly.

The alternate embodiment A' of the assembly shown in part of FIG. 6 differs from the preferred embodiment only with respect to the lower end of the sleeve 62 thereof That is, as in the first embodiment, the assembly includes an intermediate riser pipe 61 identical to that of the first embodiment including a ball shaped part 63 adjacent its lower end which is formed symmetrically of the axis of the pipe and which is of a diameter for passing the enlarged upper end of the sleeve during assembly or disassembly, and a protective sleeve 62 spaced thereabout and supported from the upper portion of the riser pipe in the same manner described in connection with FIGS. 1–5.

However, in this alternate embodiment of the invention, the outer cylindrical, spherically shaped surface 63 of the lower ball shaped part of the riser pipe is guided vertically while being permitted to swivel with respect to the lower end of the sleeve by virtue of its close fit within an inner cylindrical surface 60 within the lower end of the sleeve. Thus, this surface is of essentially the same diameter as that of the ball shaped part and is vertically aligned with the axis of the pipe, whereby the pipe and sleeve are free to swivel, as well as to move vertically, with respect to one another as one elongates or shortens with respect to the other.

The first described embodiment is preferred primarily because it better protects the surfaces of the lower ball shaped part of the riser pipe and the guiding cylindrical opening in the lower end of the sleeve against wear. Thus, as will be appreciated, the disposal of the lower ball shaped part in direct contact with the opening in the lower end of the sleeve could result in wear of one or both of the surfaces.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. For use in drilling or completing a subsea well from an offshore rig which is moored to the ocean floor and which has a platform with one or more vertical compartments each of which has an opening in its lower end, and wherein a riser including a series of riser pipes connected in end to end relation is adapted to be supported for extension through a compartment with its lower end secured to a subsea wellhead at the ocean floor, an assembly comprising:

a protective sleeve spaced about an intermediate pipe of the riser which will extend through the opening in the bottom of said compartment, means including a spherically shaped surface adjacent the upper end of the sleeve which closely receives a spherically shaped surface adjacent the upper end of the intermediate riser pipe for swiveling with respect thereto, and means adjacent the lower end of the sleeve receiving a spherically shaped part adjacent the lower end of the intermediate pipe of the riser for swiveling and guided relative vertical movement with respect thereto.

2. As in claim 1, wherein:

the means adjacent the lower end of the sleeve includes a ring having a cylindrical outer side vertically slidable on an inner cylindrical surface of the sleeve and the spherically shaped surface on its inner side.

3. As in claim 2, wherein:

the ring comprises upper and lower sections split along a plane transverse to its axis, the upper ring section is made of circumferentially split segments which are disposable within an enlarged portion of the inner side of the sleeve above its cylindrical surface to permit passage of the spherical surface of the riser pipe therethrough, and means for connecting the segments together about said spherical surface.

4. As in claim 1, wherein:

the means adjacent the lower end of the sleeve comprises a cylindrical surface on the inner side of the sleeve in which the spherically shaped surface of the riser pipe is closely received for guided vertical sliding.

* * * * *